United States Patent [19]

Plucknett

[11] Patent Number: 4,558,834

[45] Date of Patent: Dec. 17, 1985

[54] YARN TENSION DEVICE

[75] Inventor: Derek W. Plucknett, Leicester, Great Britain

[73] Assignee: Trip Lite Limited, Great Britain

[21] Appl. No.: 657,665

[22] Filed: Oct. 4, 1984

[30] Foreign Application Priority Data

Oct. 8, 1983 [GB] United Kingdom ..... 8326992

[51] Int. Cl.[4] ..... B65H 59/24

[52] U.S. Cl. ..... 242/152.1

[58] Field of Search ..... 242/152.1, 147 R, 149, 242/150, 151, 152; 226/195

[56] References Cited

U.S. PATENT DOCUMENTS 2,677,511 5/1954 Bley ..... 242/152.1 X 3,309,858 3/1967 Franzen ..... 242/151 X 4,123,014 10/1978 McCullough ..... 242/152.1

FOREIGN PATENT DOCUMENTS 1965 of 1915 United Kingdom ..... 242/152.1

*Primary Examiner*—Stanley N. Gilreath

*Attorney, Agent, or Firm*—Charles W. Helzer

[57] ABSTRACT

A yarn tension device comprises a ball 10 resting on an annular seat 12 to define therebetween a yarn path whereby yarn 14 drawn along that path is tensioned. A preloaded torsion spring 22 acts on the ball 10 to exert a resilient bias thereon to urge the ball 10 against the seat 12. A control 28 is provided for varying the preloading of the torsion spring 22. The device provides a readily variable yarn tension that has a surprising constancy from one device to the next.

2 Claims, 1 Drawing Figure

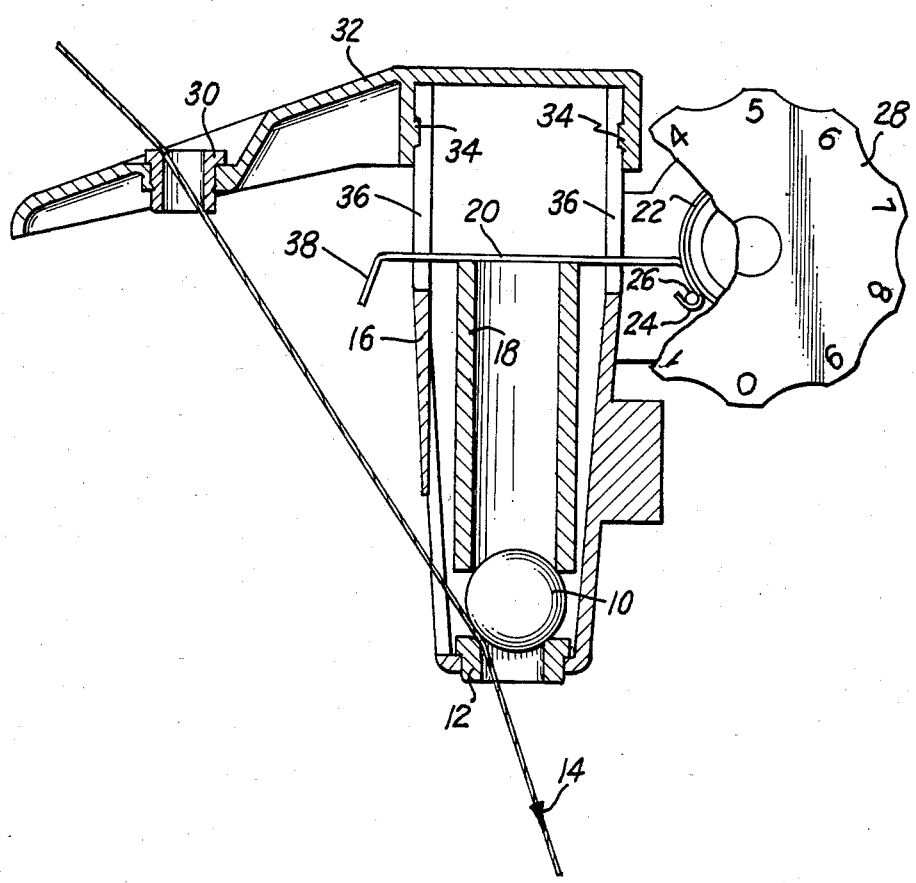
32
30
34
34
36
36
20
22
38
26
24
16
18
10
12
14
28
5
6
7
8
6
0
4

YARN TENSION DEVICE

The invention relates to yarn tension devices, for use in conjunction with textile machinery in which a constant pre-tension is required to be applied to the yarn as it is fed to the machinery.

Yarn tension devices are known in themselves, and generally comprise a pair of smooth surfaces biased together, between which the yarn is drawn. Usually it is desirable to be able to vary the bias between the surfaces so as to vary the tension applied to the yarn, and this can be achieved in a variety of ways.

If the smooth surfaces are the cooperating surfaces of a pair of cymbals biased together by a compression spring, then the bias can be varied simply by varying the compression of that spring. This is the yarn tension means most commonly adopted in domestic sewing machines and also in some industrial machines where it is unimportant that different yarn tension devices may produce different yarn tensions. However in many industrial applications the mutual consistency of the yarn tensions produced by different tension devices is of importance, and the use of a simple tensioner such as that described above is considered inadequate.

Another method that has been used successfully to achieve reliably consistent tensioning is to have one of the cooperating surfaces an annular seat, known in the art as a cup, and the other a steel ball, with the yarn passing downwardly between the ball and cup and out through an open bottom of the cup. This method of yarn tensioning is disadvantageous in that it is unidirectional: attempting to pass the yarn upwardly through the open bottom of the cup and out between the cup and ball causes the ball to jump around in the cup and results in variations in the yarn tension. Also although the tension applied by different units is reliably mutually consistent, that tension cannot readily be varied to another greater or lesser value. Generally, tension variations are obtained either by replacing one steel ball with another having a different mass or by stacking a number of auxiliary balls or other weights in a cage over the steel ball and cup. Such tension adjustment is time-consuming to the effect that there is generally a total reluctance on the part of the user to reset the yarn tension even when such resetting would improve the quality of the final product.

There is therefore a need for a yarn tension device which is both readily adjustable and mutually consistent from one device to the next. Such a device is provided by the present invention.

The invention provides a yarn tensioning device comprising a ball resting in an annular seat to define therebetween a yarn path whereby yarn drawn along that yarn path is tensioned, wherein a preloaded torsion spring acts on the ball to exert a resilient bias thereon to urge the ball against the seat, and means are provided for varying the preloading of the torsion spring, to vary the resilient bias and the resulting yarn tension.

It is very significant that in the invention the spring biassing the ball against the seat is a torsion spring. It has been found that of many alternative spring means available, only a torsion spring is fully suitable in all the circumstances. Its spring loading is precise and constant, and can moreover be accurately predicted from spring dimensions. Thus a spring comprising a helically wound coil of wire with, for example, 20 complete wraps of a given diameter and a pair of tangential wire end portions extending at a given angle in the rest condition of the spring would have a constant and reproducible preloading if the end portions were rotated one relative to the other through a given angle. More importantly, that preloading would be the same, within acceptable limits, as the preloading of a similar spring made to the same specification. This ensures constancy of yarn tensioning between different yarn tensioners.

Preferably in the device of the invention the weight of the ball acts downwardly on the annular seat and is augmented by the spring bias, but this is not necessary and in some circumstances it may be desirable to increase the preloading of the spring until it is more than sufficient to support the weight of the ball, and then to invert the device and use it in a position in which the ball tends naturally to fall away from the seat. This of course is something not possible with prior art ball tensioners, and can in some applications be a distinct advantage.

In the more usual arrangement in which the ball acts downwardly on its seat it is possible to supplement the weight of the ball by stacking a number of other auxiliary balls or weights in a cage over the ball, as in the prior art. The principal advantage of the invention in such an arrangement is that the torsion spring is used to 'trim' or add a supplementary small bias to, the stack of balls or weights in the case which enables far more accurately reproducible and mutually consistent tensions to be imparted to the yarns passing through a number of such devices than previously thought possible.

Preferably the torsion spring comprises a coiled wire spring having at one end a torque reaction arm for imparting the resilient bias on the ball and at the other end an end portion connected to an adjustment wheel for varying the torsion in the spring.

DRAWING

The single FIGURE drawing is a vertical section through a yarn tensioning device according to the invention.

A steel ball 10 is seated in an annular seat 12 which also acts as a yarn guide eyelet. The annular seat 12 is made from a ceramic material, and the ball 10 and seat 12 present a pair of smooth cooperating surfaces between which the yarn 14 is drawn in use.

Over the ball 10 and seat 12 is a cage 16 in which additional balls can be stacked if desired. Above the ball 10, or above the topmost ball in the stack, is a cylindrical spacer member 18 of plastics material, preferably a material such as nylon which has a low coefficient of friction and which permits the ball to turn freely in its seat. One limb comprising a torque reaction arm portion 20 of a torsion spring 22 is arranged to bear downwardly on the spacer member 18, the other limb 24 comprises an anchor end portion of torsion spring 22 and is hooked around a projection 26 of a torsion spring load adjustment wheel 28. Between its end portions 20 and 24, the torsion spring 22 is wrapped for multiple turns around a central hub of the wheel 28.

Around the perimeter of the wheel 28 is a series of markings such as numbers which enable the loading of the spring to be varied to any of a range of preset loadings. The consistency of the preloading of a torsion spring is such that, if a series of such devices is made and the springs set to the same preloading in the factory, then identical yarn tensions will be produced throughout the series of devices merely by setting all the wheels 28 to the same setting.

A yarn infeed guide 30 is mounted on an arm 32 extending from the top of the cage 16. A preferred feature of the apparatus illustrated is that the yarn infeed guide arm 32 can be rotated about the vertical axis of the cage 16, to enable the yarn 14 to be guided from any desired angle. A pair of detents 34 can engage any of a number of axial slits 36 in the top of the cage 16, to give positive location of the arm 32 in a predetermined number of advantageous angular positions relative to the rest of the device.

The limb 20 of the torsion spring 22, which forms the torque reaction arm bearing down on the spacer member 18, is extended through the cage 16 and terminates in a downturned end portion 38. This can be raised manually and latched into a side recess (not shown) in the slot 36 through which the limb 20 passes, so as selectively to release the spring bias from the ball 10. This provides a simple and efficient means of selectively reducing the tension applied by the device, for example for use while setting up the associated textile machinery.

Two advantages of the illustrated yarn tensioner should be noted. The first is the constancy and reproducibility of yarn tensions produced by different yarn tensioners of similar construction. The ability to produce constant tensions from one device to the next is important in textile machinery such as knitting machines, and the device of the invention has for the first time coupled this constancy with a simple means for tension adjustment, by calibrating the wheel 28.

The second advantage is that the yarn direction can be reversed with the device operating with equal effectiveness. There is no noticeable tendency for the ball 10 to rattle around in its seat 12 as there would be with a conventional ball tensioner.

The relative importance of these two advantages will vary depending on the textile machinery with which the device is to be used.

I claim:

1. A yarn tensioning device comprising:

a housing;

an annular seat member supported by the housing;

a ball resting on the annular seat member in contact with an annular seat thereof;

means defining a yarn path through the tensioning device, between the ball and the annular seat;

a torsion spring supported by the housing, the torsion spring comprising a coiled wire spring portion, a torque reaction arm portion at one end of the coiled wire spring portion and engaging the ball for exerting a resilient bias on the ball to urge the ball against the annular seat, and an anchor end portion of the torsion spring at the other end of the coiled wire spring portion; and adjustment wheel means supported by the housing and secured to the said anchor end portion of the torsion spring for varying the torsion in the spring.

2. A yarn tensioning device according to claim 1 wherein the housing further includes a cage portion containing the ball, and the cage portion further contains at least one auxiliary weight or further ball acting downwardly on the said bll to increase the effective weight thereof.

* * * * *